United States Patent [19]

Saito et al.

[11] Patent Number: 4,697,722

[45] Date of Patent: Oct. 6, 1987

[54] METHOD FOR DESIGNING AND MAKING A TAPPING STOPPER

[75] Inventors: Tadao Saito, Adachi; Riichi Ogawa, Matsudo, both of Japan

[73] Assignee: Yoshino Kogyosho Co., Ltd., Japan

[21] Appl. No.: 916,276

[22] Filed: Oct. 7, 1986

Related U.S. Application Data

[63] Continuation-in-part of Ser. No. 693,988, Jan. 23, 1985, abandoned, which is a continuation of Ser. No. 370,292, Apr. 2, 1982, Pat. No. 4,531,657.

[51] Int. Cl.[4] ..... B65D 5/72

[52] U.S. Cl. ..... 222/571

[58] Field of Search ..... 222/108, 109, 566, 571, 222/569, 547, 111

[56] References Cited

U.S. PATENT DOCUMENTS

| | | | |
|---|---|---|---|
| 3,369,710 | 2/1968 | Lucas | 222/109 |
| 3,459,315 | 8/1969 | Labarre | 222/541 |
| 3,833,150 | 9/1974 | Visser-Patings | 222/109 |
| 4,264,022 | 4/1981 | Perne et al. | 222/547 |

FOREIGN PATENT DOCUMENTS

| | | | |
|---|---|---|---|
| 451399 | 8/1936 | United Kingdom | 222/571 |

*Primary Examiner*—Joseph J. Rolla
*Assistant Examiner*—Michael S. Huppert
*Attorney, Agent, or Firm*—Parkhurst & Oliff

[57] ABSTRACT

A tapping stopper for a bottle is provided to prevent the content liquid from trickling along the outside of the bottle when pouring. The tapping stopper comprises a pouring cylinder having a trumpet-shaped lip, an auxiliary external cylinder having a trumpet-shaped lip, and a bottom plate connecting the pouring cylinder and the auxiliary external cylinder. The pouring cylinder and auxiliary external cylinder from a peripheral groove between them. The height difference between the cylinders is determined according to the viscosity of the content liquid.

2 Claims, 2 Drawing Figures

METHOD FOR DESIGNING AND MAKING A TAPPING STOPPER

This is a continuation-in-part of application Ser. No. 693,988, filed Jan. 23, 1985, abandoned, which is a continuation of Ser. No. 370,292, filed Apr. 2, 1982, U.S. Pat. No. 4,531,657.

BACKGROUND OF THE INVENTION

This invention relates to a tapping stopper which is tightly fitted to the mouth of a bottle containing a liquid. The tapping stopper of this invention is intended to prevent the liquid from trickling along the outside of the bottle when the liquid is poured out.

There are many kinds of tapping stoppers which are fitted to the mouth of a bottle containing a liquid to permit the liquid to be poured out smoothly without trickling. Many of these tapping stoppers have a top end which has a trumpet-shaped pouring cylinder which effectively prevents trickling.

The tapping stoppers of the aforesaid structure are effective to prevent trickling to some extent, but are not completely effective. They are almost completely ineffective when a viscous liquid is poured out.

The conventional tapping stoppers are effective when the bottle is tilted quickly to pour the content liquid and the bottle is restored upright again quickly. However, they do not work effectively when the bottle is tilted slowly to pour the liquid little-by-little, or when a bottle which is close to full is slightly tilted.

SUMMARY OF THE INVENTION

This invention was developed in view of the foregoing background and to overcome the foregoing drawbacks.

This invention provides a tapping stopper having a pouring cylinder which has a double-walled structure. Liquid which trickles from the main pouring cylinder is received by an auxiliary pouring cylinder. The liquid thus received is prevented from trickling from the auxiliary pouring cylinder by the surface tension of the content liquid being poured from the main pouring cylinder, whereby trickling is prevented with certainty.

BRIEF DESCRIPTION OF THE DRAWINGS

The above objects, features and advantages of the present invention will become more apparent from the description of the invention which follows, taken in conjunction with the accompanying drawings, wherein like reference numerals denote like elements, and wherein.

DETAILED DESCRIPTION OF THE INVENTION

Figure 1:
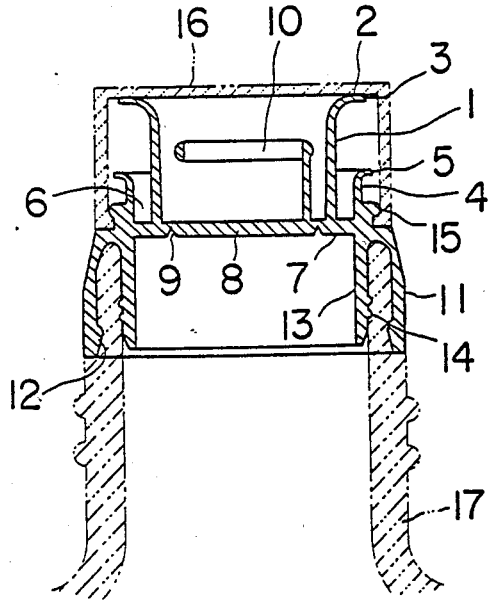
FIG. 1 is a longitudinal sectional view showing one embodiment of the invention.
Figure 2:
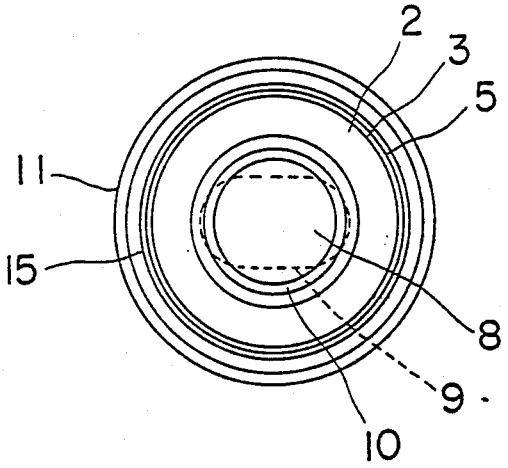
FIG. 2 is a plan view of the embodiment of the invention shown in FIG. 1.

The invention will be described in detail with reference to the accompanying drawings which illustrate a preferred embodiment according to the present invention.

In use, the tapping stopper of this invention is tightly fitted to the mouth of a bottle 17 containing a liquid. The tapping stopper is made up of the pouring cylinder 2, the auxiliary external cylinder 4, and bottom plate 7. The pouring cylinder 1 has a trumpet-shape and a flattened top end 2. The auxiliary external cylinder 4, which is lower than the pouring cylinder 1, also has a trumpet-shaped top end. The pouring cylinder 1 and the auxiliary external cylinder 4 form a narrow circular groove 6 between them. The bottom plate 7 connects the lower ends of the pouring cylinder 1 and the auxiliary external cylinder 4.

The tapping stopper may be tightly fitted to the mouth of a bottle 17 in a suitable manner which is not specifically limited. In the illustrated embodiment, an internal cylinder 13 and the external cylinder 11 are provided to tightly fit the tapping stopper to the mouth of a bottle. The internal cylinder 13 extends downward from the periphery of the bottom plate 7 with several ridges 14 formed thereon and fits into the mouth of a bottle 17 to make a seal. The external cylinder 11 extends downward from the periphery of the bottom plate 7 with a locking ridge 12 formed thereon and fits on the mouth of a bottle 17, ensuring locking.

In FIG. 1, it should be noted that the auxiliary cylinder 4 is much lower than the pouring cylinder 1. The difference in height is determined according to the viscosity of the liquid to be filled in the bottle 17. The higher the viscosity, the greater the difference.

The height difference between the auxiliary cylinder 4 and the pouring cylinder 1 is preferably experimentally determined for each liquid to be used. The liquid is placed in a bottle and poured through tapping stoppers having various heights. If trickling occurs the height is adjusted.

For example, a liquid having an unknown viscosity, the liquid is poured through a tapping stopper having a minimal height difference (e.g., 0.5 mm). If trickling occurs the height difference is gradually increased until trickling no longer occurs. The height difference is then continually gradually increased until trickling once again occurs. The range of heights between which trickling does not occur is the acceptable height range.

The following experimentally determined height differences for various liquids have been determined;

For a machine oil having a viscosity of 16 cp, a height difference of 3 mm is acceptable but a height difference of 2.5 mm is not acceptable;

For a machine oil having a viscosity of 59 cp, a height difference of 4 mm is acceptable and a height difference of 3 mm is not acceptable;

For oils having a viscosity of 55 cp (e.g., camellia oil or sesame oil), a height difference of 4 mm is acceptable but a height difference of 3 mm is not acceptable.

If the viscosity of the liquid is known, the above height differences can be used as starting points and the height difference can be adjusted accordingly. For example, if the viscosity of the liquid is larger than 16 cp, a height difference of 3 mm can be tried and the height difference can be gradually increased until a sufficient height difference is reached.

In the case of a mixture of oils, the requisite height difference may be slightly greater. For example, for salad oil, having a viscosity of approximately 55 cp, a height difference greater than that of sesame oil having the same viscosity is required.

Moreover, it should be noted in FIG. 1 that the lip 5 of the auxiliary cylinder 4 projects outward slightly beyond the lip 3 of the pouring cylinder 1, so that the liquid trickling from the lip 3 of the pouring cylinder 1 is caught certainly by the peripheral groove 6. Another reason for such an arrangement is to ensure the prevention of trickling. When the content liquid is poured, the liquid may partly trickle along the lower side of the lip 3 of the pouring cylinder 2, and the trickling liquid is received by the groove 6 and then discharged from the lip 5 of the auxiliary cylinder 4. In such pouring, the flow from the lip 3 of the pouring cylinder 2 pulls up the flow from the lip 5 of the auxiliary cylinder 4 due to surface tension of the content liquid being poured. This action resulting from surface tension ensures the prevention of trickling.

It is also possible to arrange the lip 5 inside the lip 3 so long as trickling is to be prevented by surface tension of the content liquid as above mentioned. However, arranging the lip 5 outside the lip 3 is advantageous in view of the relative position of the two lips, with the bottle tilted for pouring.

The top 2 of the pouring cylinder 1 is made flat so that a certain quantity of content liquid is on the top of the pouring cylinder 1 for effective use of surface tension when the liquid is poured and that the liquid remaining in the form of drop on the end of the lip 3 is returned to the inside of the pouring cylinder when the titled bottle is restored.

In the illustrated embodiment, the lower end of the pouring cylinder 1 is closed with the extension of the bottom plate 7. The extension is provided with the cutting groove 9, the removable piece 8, and the pulling ring 10. The lower periphery of the auxiliary cylinder 4 is provided with a ridge 15 which engages with the cap 16.

Before pouring the content liquid for the first time, the user opens the bottle 17 by pulling up the pulling ring 10 until the removable piece 8 is broken along the cutting groove 9.

The content liquid is poured when the bottle 17 is tilted, but the content liquid tickles along the underside of the lip 3 of the pouring cylinder 1 when the tilt angle is changed to adjust the pouring quantity. The content liquid which has trickled along the underside of the lip 3 of the pouring cylinder 1 is received by the peripheral groove 6 and then poured out along the auxiliary external cylinder 5.

When the bottle 17 is tilted to such a position that the content liquid pours from the lip 5 of the auxiliary cylinder 4, the content liquid pours from the lip 3 of the pouring cylinder 1 as a matter of course. Thus, the flow from the lip 5 is attracted by the flow from the lip 3 due to the surface tension of the content liquid. In this manner, the content liquid is prevented from trickling along the tapping stopper.

If the distance between the lip 3 and the lip 5 is too short as compared with the viscosity of the content liquid, the content liquid will bridge the two lips. This decreases the effect of surface tension and hence greatly deteriorates the effect of preventing trickling.

The liquid pouring from the lip 3 exerts an upward force on the liquid pouring from the lip 5 due to surface tension. In the same way, the liquid pouring from the lip 5 exerts a downward force on the liquid pouring from the lip 3. However, the combined flow starts from the point near the lip 3, and the content liquid never trickles along the underside of the lip 5 of the auxiliary external cylinder 4.

It is to be noted that it is the secondary function for the peripheral groove 6 formed between the pouring cylinder 1 and the auxiliary external cylinder 4 to receive the liquid trickling along the outside of the pouring cylinder 1. The principal object is to permit the liquid guided by the auxiliary cylinder 4 to be combined with the main flow pouring from the pouring cylinder 1 due to affinity for the peripheral surface of the pouring cylinder 1. Therefore, the peripheral groove 6 is not very wide (e.g., the peripheral groove is about 2.5 to 3 mm for viscous liquids like frying oil).

As mentioned above, the tapping stopper of this invention is capable of preventing the content liquid, even when it is viscous, from trickling along the stopper. This effect is achieved due to the viscosity of the content liquid, and therefore, the action is certain and the structure is simple and easy to make.

While the preferred embodiments of the invention have been described, it is to be understood that the invention is not limited thereto, and may be otherwise embodied within the scope of the following claims.

What is claimed is:

1. A method of designing and making a tapping stopper to be tightly fitted to the mouth of a bottle containing a liquid, the tapping stopper comprising:

a pouring cylinder with a cylindrical surface, an annular lip extending perpendicularly to an axis of said cylindrical surface, and a transitional surface, said transitional surface having a curved surface joining an end of the cylindrical surface and an inner diameter of the annular lip;

an auxiliary external cylinder; and a bottom plate connecting the pouring cylinder and the auxiliary external cylinder, the pouring cylinder and the auxiliary external cylinder being arranged to form a peripheral groove and the auxiliary external cylinder being formed below the pouring cylinder by a certain height difference;

the method comprising:

determining a viscosity of the liquid to be poured from a tapping stopper;

determining the appropriate height difference between the pouring cylinder and the auxiliary external cylinder of such a stopper for a liquid having the determined viscosity, selecting said appropriate height difference such that during pouring of the liquid from the pouring cylinder, the flow of liquid from the pouring cylinder will pull up on any flow of liquid from the auxiliary cylinder due to the surface tension of the liquid so that any flow of liquid from the auxiliary cylinder will be combined with the flow of liquid from the pouring cylinder to prevent trickling; and manufacturing said tapping stopper having the determined appropriate height difference as said certain height difference between the pouring cylinder and the auxiliary external cylinder thereof.

2. A method for designing and making a tapping stopper to be coupled to the mouth of a bottle for pouring a liquid from the bottle and preventing the poured liquid from trickling over the bottle during pouring, the tapping stopper having:

a pouring cylinder with a first cylindrical surface, a first annular lip extending perpendicularly to an axis of the first cylindrical surface, and a first transitional surface, said first transitional surface having a curved surface joining an end of the first cylindrical surface and an inner diameter of the first annular lip;

an auxiliary cylinder with a second cylindrical surface, a second annular lip extending perpendicularly to an axis of the second cylindrical surface and a second transitional surface, said second transitional surface having a curved surface joining an end of the second cylindrical surface and an inner diameter of the second annular lip, said auxiliary cylinder being spaced from and coaxially surrounding the pouring cylinder and being constructed to have the second annular lip spaced from and below the first annular lip by a certain height difference;

the method comprising:

determining a viscosity of the liquid to be poured from a tapping stopper;

determining the appropriate height difference between the first and second annular lips of such a stopper for a liquid having the determined viscosity, selecting said appropriate height difference such that during pouring of the liquid through the pouring cylinder, the flow of liquid from the first annular lip will pull up on any flow of liquid from the second annular lip due to the surface tension of the liquid to form a combined flow and prevent trickling from the second annular lip; and manufacturing a tapping stopper having the thus determined appropriate height difference as the certain height difference between the first and second annular lips thereof.

* * * * *

UNITED STATES PATENT AND TRADEMARK OFFICE

CERTIFICATE OF CORRECTION

PATENT NO. : 4,697,722

DATED : October 6, 1987

INVENTOR(S) : Tadao Saito and Riichi Ogawa

It is certified that error appears in the above-identified patent and that said Letters Patent is hereby corrected as shown below:

Title page:

In the Related U.S. Application Data (item 63), line 3, change "Apr. 2, 1982" to -- Apr. 20, 1982 --.

Column 1, line 7, change "Apr. 2, 1982" to -- Apr. 20, 1982 --.

Signed and Sealed this

Twenty-third Day of February, 1988

*Attest:*

DONALD J. QUIGG

*Attesting Officer*

*Commissioner of Patents and Trademarks*